United States Patent [19]

Paquereau et al.

[11] Patent Number: 4,784,008

[45] Date of Patent: Nov. 15, 1988

[54] ANALOGUE MANIPULATOR WITH PREFERENTIAL ORIENTATIONS

[75] Inventors: Philippe Paquereau, Angouleme; Xavier Ruaud, Marthon, both of France

[73] Assignee: La Telemecanique Electrique, Nanterre Cedex, France

[21] Appl. No.: 52,474

[22] Filed: May 21, 1987

[30] Foreign Application Priority Data

May 22, 1986 [FR] France ..... 86 07289

[51] Int. Cl.[4] ..... G05G 9/02; H01H 25/04

[52] U.S. Cl. ..... 74/471 XY; 200/6 A

[58] Field of Search ..... 74/471 XY; 200/6 A; 273/148 B; 338/128

[56] References Cited

U.S. PATENT DOCUMENTS

| | | | |
|---|---|---|---|
| 2,808,476 | 10/1957 | Elliot | 200/6 |
| 3,219,782 | 11/1965 | Bissell et al. | 200/107 |
| 3,731,013 | 5/1973 | Nightengale | 200/6 A X |
| 3,744,335 | 7/1973 | Karlsson et al. | 74/471 XY |
| 3,818,154 | 6/1974 | Presentey | 200/6 A |
| 3,827,313 | 8/1974 | Kiessling | 74/471 XY |
| 4,533,899 | 8/1985 | Isaksson | 74/471 XY X |
| 4,639,668 | 1/1987 | Petit et al. | 74/471 XY X |

FOREIGN PATENT DOCUMENTS

| | | |
|---|---|---|
| EP43809 | 1/1982 | European Pat. Off. . |
| 1268251 | 5/1968 | Fed. Rep. of Germany . |
| 7340888 | 11/1973 | Fed. Rep. of Germany . |
| 3442287 | 5/1986 | Fed. Rep. of Germany . |
| 2559305 | 8/1985 | France . |
| 2046022 | 11/1980 | United Kingdom . |

*Primary Examiner*—Allan D. Herrmann

*Attorney, Agent, or Firm*—Young & Thompson

[57] ABSTRACT

The manipulator delivers signals characteristic of the orientation of an operating lever (2) in space. The lever is deflectable by a transverse thrust, from a reference or neutral position, and is elastically returned to that neutral position. The lever (2) is articulated on a casing to control the position of at least one movable member (3) interacting with at least one pick-up (4) to deliver an electrical signal dependent upon the position of the lever. Two cams (7, 8) resiliently biased toward each other oppose to the angular deflection of the operating lever (2) an elastic reaction which differs according to the orientation of the lever (2) with respect to its neutral position. In an embodiment, these cams are carried respectively by a ball joint of the lever and by a piston slidable in the casing and urged by a spring.

8 Claims, 7 Drawing Sheets

ANALOGUE MANIPULATOR WITH PREFERENTIAL ORIENTATIONS

This invention relates to an analogue manipulator for generating electrical control signals in response to various orientations in space imparted to an operating element of said manipulator, such as a lever, which will hereinafter be designated the "operating lever".

Manipulators of this kind are often used for the electrical remote-control of the movements of a movable element, e.g. the hook of a lifting mechanism, more particularly a travelling crane, in four main directions which are orthogonal in pairs.

For reasons of economy and rationalization of manufacture, some of these manipulators have foolproofing means, comprising a cruciform aperture with four arms orthogonal in pairs and having the operating lever extending therethrough. In this way, the lever can be oriented only in the four directions determined by the arms of the cross. This solution is suitable when the movement of the movable element controlled by the manipulator is to be effected only in orthogonal directions.

Conversely, in French patent application No. 2 559 305 applicants have provided an analogue manipulator allowing omnidirectional movement of the operating lever without any direction being preferential.

In some applications, the frequency of movements of the lever in two orthogonal directions predominates, but provision must be made occasionally for lever orientation in intermediate directions in order, for example, to give an oblique movement of the movable element controlled by the manipulator. In such applications, applicants have discovered the advantage that the resistive force developed against at least one preferential orientation of the lever is much weaker than that developed against other possible inclinations of the lever. This anisotropy of the reaction perceived by the operator's hand gives him information regarding the orientations under control, the orientations of the operating lever in the main rectangular planes being easier to transmit to it than all the other inclinations.

One of the objects of this invention, therefore, is to provide an analogue manipulator having a reaction anisotropy to the operator depending upon the orientation engaged, the manipulator dimensions being as small as possible bearing in mind the small space available on control panels, and finally the manipulator should be reliable and inexpensive to manufacture.

Another object of the invention is to allow easy modification of the preferential orientations selected, both in terms of number and direction, by replacement of a minimum number of components.

The manipulator according to the invention thus comprises a casing on which the said lever is articulated to control the position of at least one movable element connected to at least one pick-up to deliver an electrical signal which is a function of the lever position.

According to the invention, this manipulator is characterised in that it comprises means counteracting the angular displacement of the operating lever by an elastic reaction which differs according to the orientation of the lever in relation to its neutral position, said means comprising surfaces which are movable with respect to one another and are held elastically in mutual contact, one being angularly linked to the orientation of the lever and the other being angularly fixed, at least one of said contacting surfaces having corrugations, the amplitude of which is dependent on the possible orientations of the lever.

Thus inclinations of the operating lever along a certain number of preferential planes will be more easy to carry out by the operator than inclinations of the lever along a certain number of other planes.

Preferably, the means for producing a differential elastic reaction comprise two associated cams, at least one of which is mounted slidably and which are elastically biased towards one another, one of said cams being angularly fixed and the other being orientable depending upon the position of the operating lever with respect to its neutral position, the active surfaces of the two cams which can come into contact with one another being so profiled that the distance between the two cams varies in dependence on the orientation of the operating lever.

According to one advantageous characteristic of the invention, one of the cams is coaxial with the neutral position of the operating lever, the other cam being coaxial with the latter. Also, at least one of the cams has a crowned corrugated profile, the corrugations corresponding to the orientations of the operating lever for which a differential elastic reaction is provided.

It will therefore readily be seen that the provision of the cams does not affect the dimensions of the manipulator, which can still be kept very compact.

According to one embodiment of the aforesaid kind, the operating lever is articulated on the casing by means of a swivel joint which is elastically urged towards a fixed annular bearing surface of the casing, said swivel joint bearing at least one movable member controlling position pick-ups mounted in the casing.

Thus the lever is articulated on the casing in a simple and economic way.

Preferably, the swivel joint bears a set of radial ribs on the side remote from the fixed bearing surface, said ribs engaging in radial slots of an elastic diaphragm on which the swivel joint bears.

Thus when the operating lever experiences a transverse thrust and is then released the swivel joint is elastically biased by the diaphragm so that the lever is automatically returned to its neutral positon.

According to a first embodiment of the invention, the operating lever is made in one piece, is directly connected to a swivel joint and bears one of the cams mounted slidably along its axis, said cam being biased towards the other cam by a spring coaxial with said lever.

Thus compression of the spring is maximum in the angular positions of the lever corresponding to the orientations where the resisting force must be greatest.

According to a second embodiment of the invention, the operating lever is connected by a spherical articulation to an auxiliary shaft housed in the casing, said shaft itself being mounted on a swivel joint elastically biased towards a fixed annular bearing surface of the casing.

This assembly provides a step-down of the movement such that a small transverse thrust on the lever allows a large range of movement of the lever in preferential directions.

Preferably, in the above second embodiment, the control lever is secured for orientation to a cam having a corrugated contour and itself connected to the spherical articulation, the casing also containing a sliding push rod surrounding the auxiliaryshaft and displaceable coaxially of the neutral position of the level, said push rod bearing a non-rotary cam having a corrugated contour cooperating with the cam borne by the lever.

Other features of the invention will be apparent from the following description with reference to the accompanying drawings, which are given by way of example without limiting force to illustrate specific embodiments of the invention and wherein.

Figure 14:
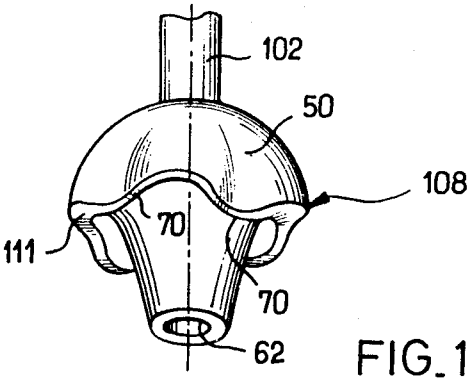
Figure 15:
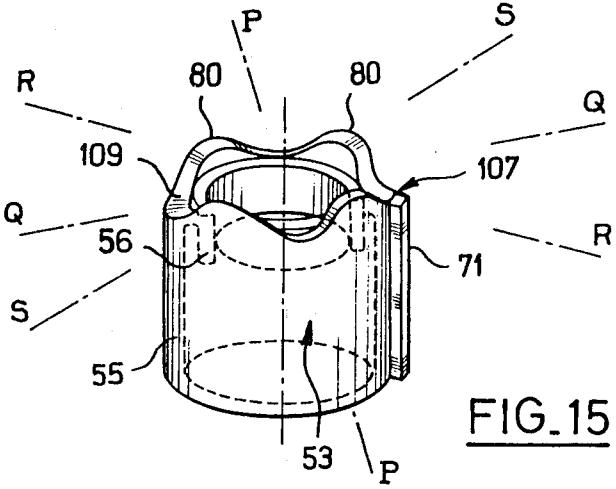
Figure 12:
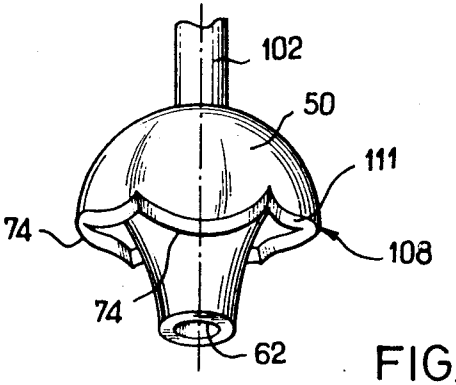
FIGS. 12 and 13 are perspective views of the cams of the manipulator shown in FIGS. 9 to 11 according to a first embodiment.
Figure 13:
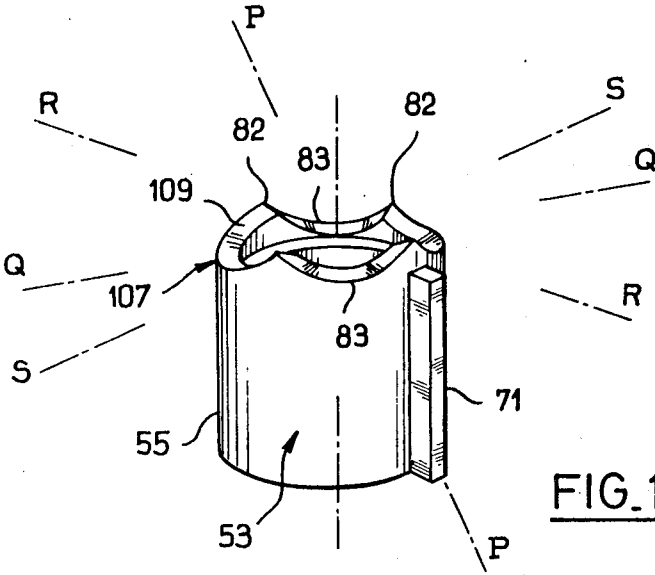
Figure 16:
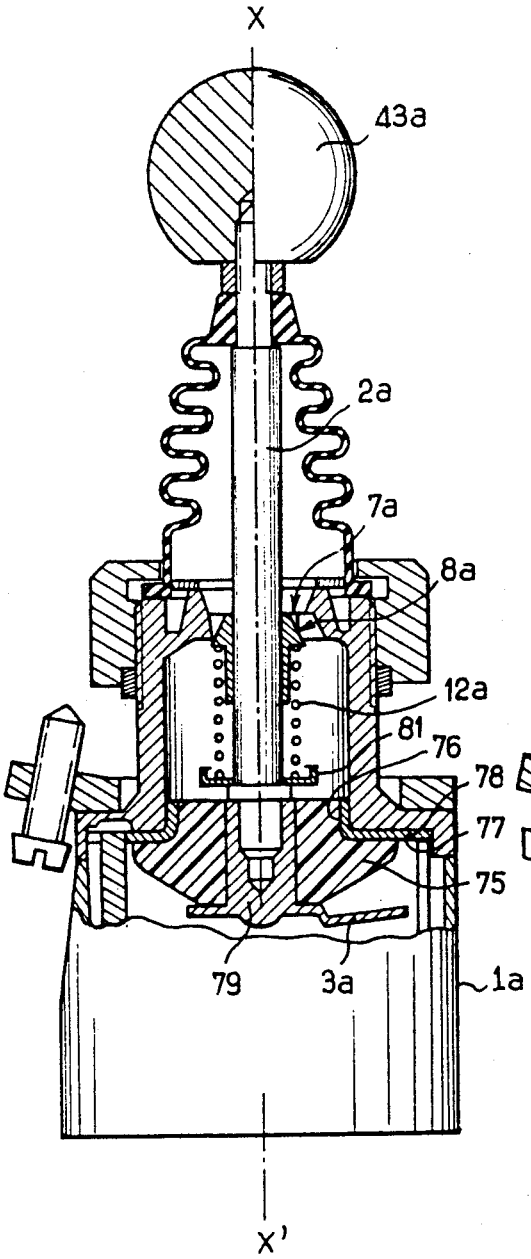
Figure 17:
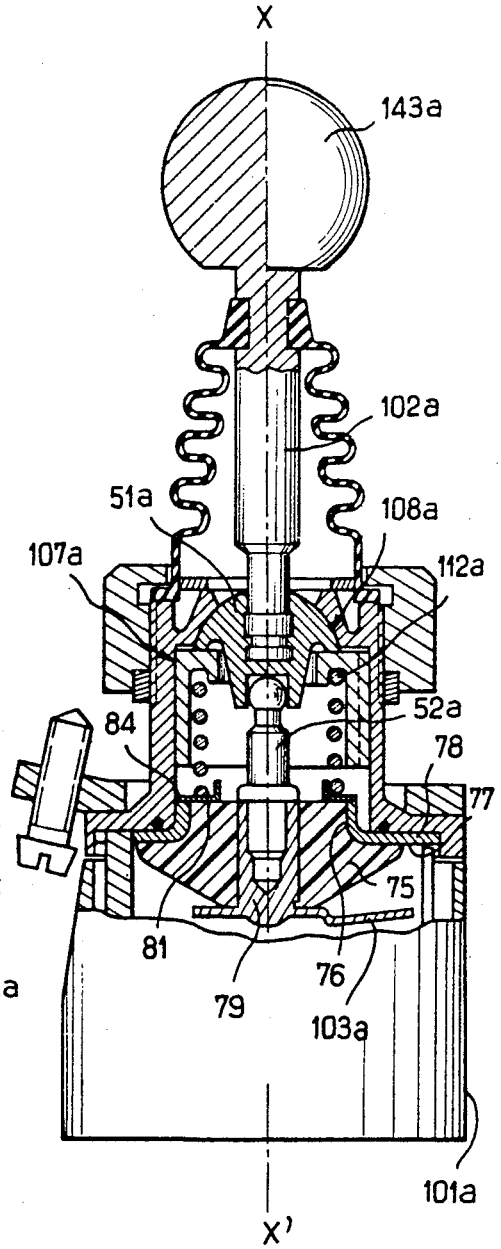

FIGS. 14 and 15 are similar views to FIGS. 12 and 13 but relating to a second alternative embodiment, and FIGS. 16 and 17 are axial sections of manipulators according to other variant embodiments of the invention.

In the first embodiment of the invention described with reference to FIGS. 1-8, the manipulator comprises essentially a casing 1 on which there is articulated an operating lever 2 which can be moved by a transverse thrust F (FIG. 2) from a reference or neutral position X-X' (FIG. 1) corresponding to the centre-line of the casing 1, the lever 2 being elastically returned to said neutral position. Lever 2 controls the position of at least one movable control member 3 associated with at least one pick-up 4 fixed to the casing 1 to deliver an electrical signal which is a function of the position of the lever 2.

Figure 1:
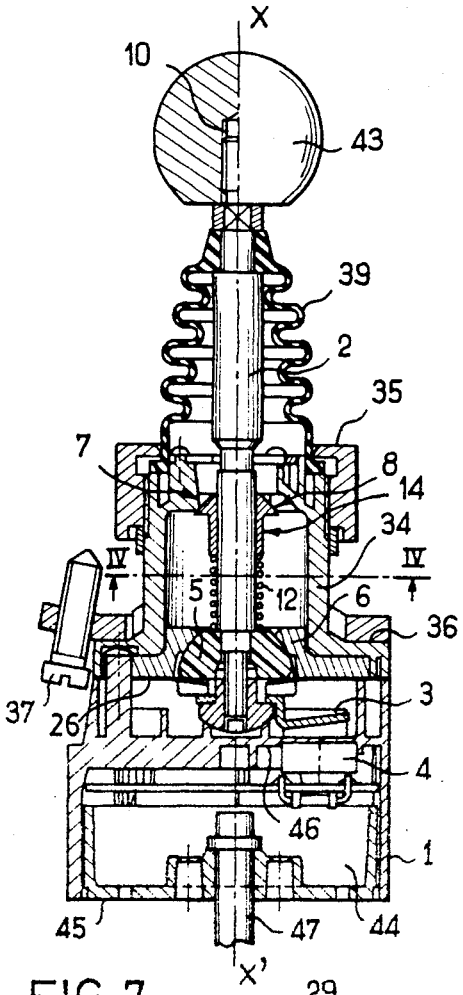
FIG. 1 is an axial section of a manipulator according to the invention, the operating lever being in its neutral position.
Figure 2:
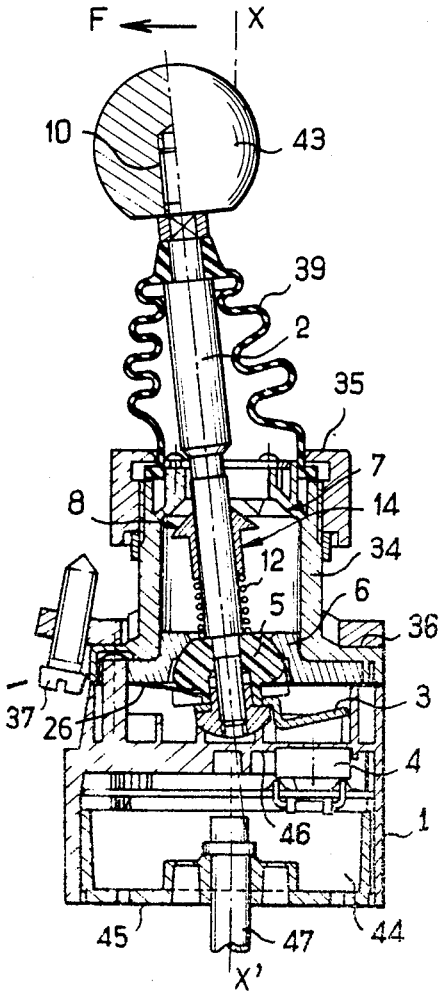
FIG. 2 is a similar view to FIG. 1, the operating lever being inclined in one of its preferential angular positions.
Figure 7:
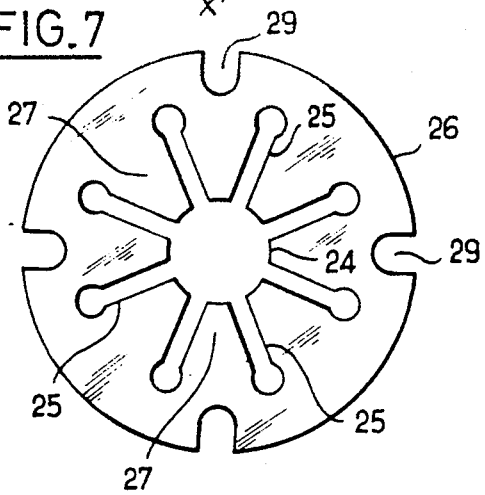
FIG. 7 is a plan view of the elastic diaphragm.
Figure 8:
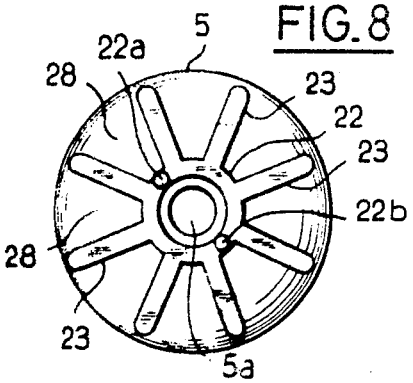
FIG. 8 is a bottom plan view of the swivel joint to which the manipulator lever is connected.
Figure 3:
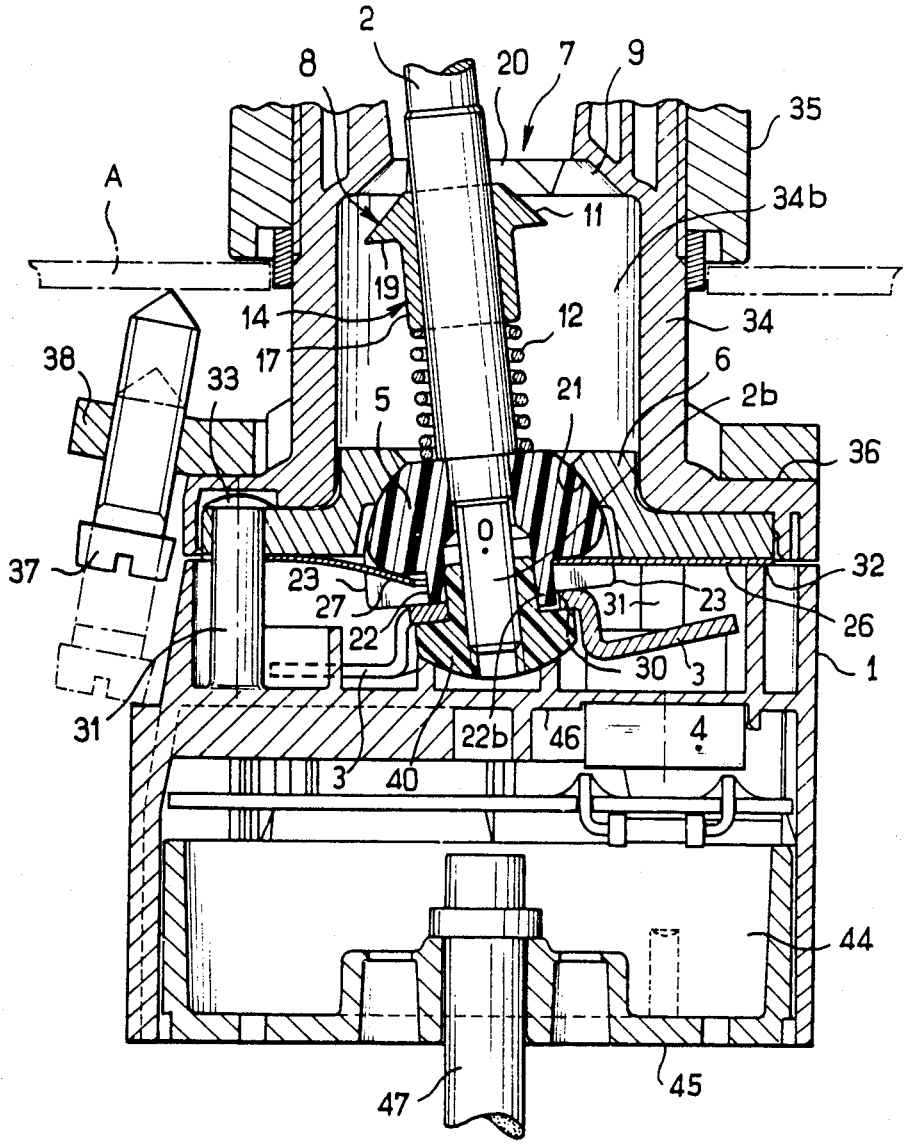
FIG. 3 is a partial axial section of FIG. 2 on an enlarged scale.
Figure 4:
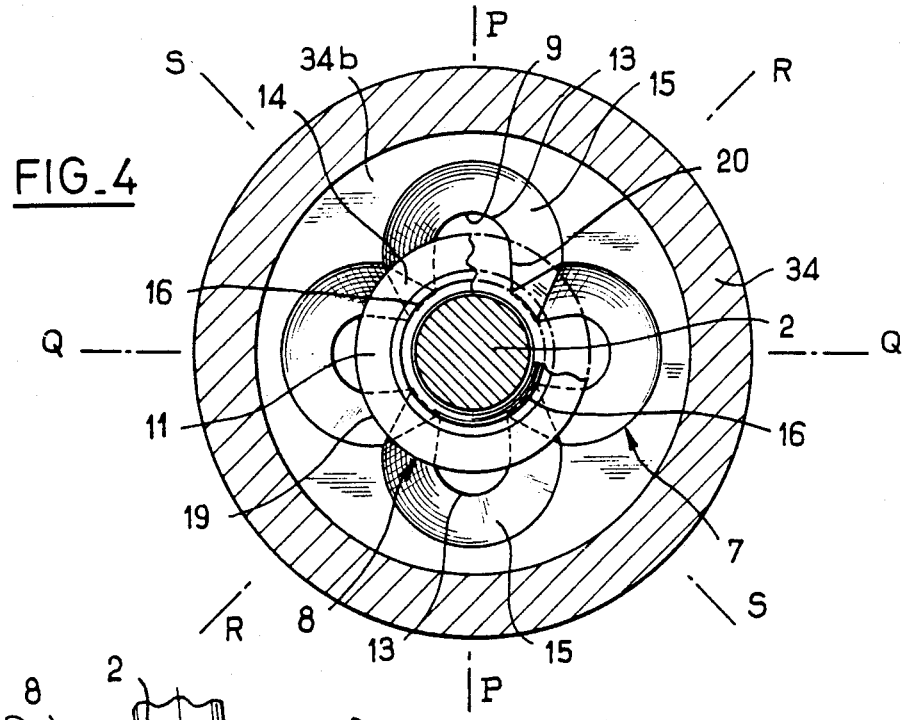
FIG. 4 is a cross-section on the line IV—IV in FIG. 1.

The operating lever 2 is articulated on the casing 1 through the agency of a swivel joint 5 carrying the or each movable control member 3. The swivel joint 5 is elastically urged towards an annular bearing surface 6 of the casing 1 and its outer spherical surface bears on the spherical cavity 21 of the bearing surface 6, the contacting surfaces being concentric with centre O (FIG. 3).

According to the invention, means are provided which counteract angular movements of the lever 2 by an elastic reaction which differs according to the orientation given to it with respect to its neutral position. These means comprise two associated cams 7 and 8, the active surfaces 9 and 11 of which have profiles adapted to provide a substantial variation in the force required to move the lever 2 from its neutral position according to the orientation that the operator wishes to give it. Further details regarding the profiles of these cams will be given hereinafter with reference to FIGS. 4 to 6.

The cams 7 and 8 are elastically biased by a helical spring 12 coaxial with the lever 2 and bearing on the swivel joint 5. In the neutral position of the lever 2, the profile of one of the cams matches that of the other (see FIG. 1), the active bearing surfaces being in mutual engagement.

The angularly fixed cam 7 is coaxial with the neutral position X-X' and the other cam 8, which is adapted to be angularly oriented in dependence on the position of the lever 2, is coaxial with the latter.

In the example illustrated (FIGS. 4-6), the fixed cam 7 has a series of notches 13 borne by the casing 1 and the angularly orientable cam 8 is borne by a slide 14 movable along the lever 2 and directly subject to the action of the spring 12. The notches 13 of the fixed cam 7 are formed in a thin frusto-conical aperture 20 formed in the end part of a cylindrical barrel 34 forming an extension of the casing 1. The aperture 20, through which the lever 2 extends, has a substantially cruciform cross-section with four circular lobes 15 disposed symmetrically in relation to the centre of the cross. These lobes 15 are connected in pairs by arcuate parts 16.

The slide 14 (see FIGS. 5 and 6) comprises a ring 17 serving as a support for the spring 12 and a short frusto-conical part 19 which narrows towards the end 10 of the lever 2 intended for manipulation. The frusto-conical part 19 forms the active bearing surface 11 of the cam 8.

In the neutral position of the operating lever 2, the frusto-conical part 19 of slide 14 matches the arcuate parts 16 of the aperture 20. As will be apparent from FIG. 4, two pairs of preferential angular orientations are provided for the operating lever 2. The first corresponds to the orthogonal planes P, Q extending in the direction of the arms of the above-mentioned cross and the second pair corresponds to the orientations R and S of the lever 2 in the planes bisecting the previous planes.

The swivel joint 5 (see FIG. 8) bears a ring 22 on the side remote from the fixed bearing surface 6, said ring being coaxial with the operating lever 2, and having a number of radial ribs 23 radiating from t. The ring 22 and the ribs 23 are respectively engaged in a central circular aperture 24 (FIG. 7) and in radial slots 25 formed in an elastic diaphragm 26 on which the swivel joint 5 bears. The diaphragm 26 forms tongues 27 selectively engaged by the base of the swivel joint 5 according to the orientation of the lever 2. In the neutral position of the lever, each sector 28 of the base of the swivel joint 5 contained between two consecutive ribs 23 bears equally against a corresponding tongue 27 of the diaphragm 26. The periphery of the diaphragm 26 which (see FIG. 7) has centring notches 29 engaging in lugs 31 of the casing 1, is clamped between an annular shoulder 32 of the casing 1 and the base of the annular bearing surface 6. The assembly is fixed by screws 33 engaged in tapped recesses in the lugs 31 of the casing 1.

The bottom screwthreaded end 2*b* of the operating lever 2 which extends through an aperture 5*a* of the swivel joint 5 extends beyond the ring 22 and receives a nut 40 which fixes and centres control members 3 by clamping them against the ring 22 of the swivel joint 5. The ring 22 has two lugs 22*a*, 22*b* (FIGS. 3 and 8) to fix the orientation of the members 3 by engaging in a centring hole 30 therein. The electronic circuits to which there belong the position pick-ups controlled by the movable members 3 are disposed in a chamber 44 of the casing 1 closed by an end 45 and separated from the swivel joint 5 by a partition 46 of electrically insulating material. These electronic circuits, which are intended to interpret the interaction between the movable members 3 and the pick-ups 4 resulting from orientation of the lever 2 in order to deliver an electrical signal which is a function of such orientation are, for example, of the kind described in Applicants' French patent application No. 2 559 305. A cable 47 is used to carry the signals to the device being controlled (not shown).

The barrel 34 capping the casing 1 forms an inner chamber **34*b* which houses the cams 7, 8 and the spring 12 while allowing angular movement of the lever 2. The end part of the barrel 34 is screwthreaded and receives a clamping ring 34 which contribute to fixing the manipulator on a plate A (FIG. 3) against levelling screws 37 carried by a flange 38 which in turn bears on the shoulder 36 of the casing 1**.

The top end of the barrel 34 is closed in known manner by a flexible cylindrical sealed gaiter 39 clamped at its base by the screwthreaded ring 35 and at the top by the knob 43 of the lever 2.

Figure 5:
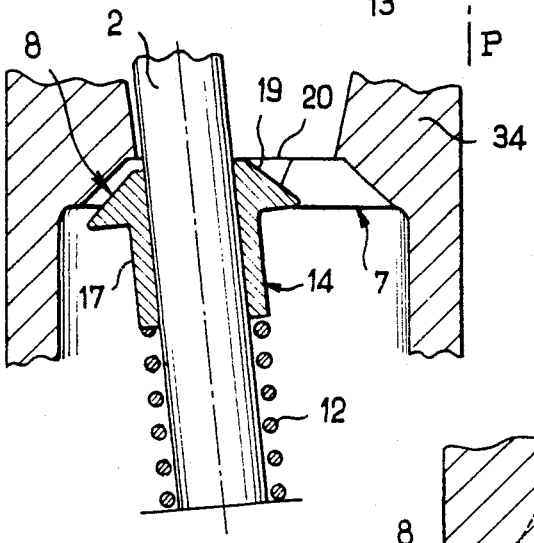
FIG. 5 is an enlarged-scale view of the cams of the manipulator shown in FIG. 1 when the lever is inclined in an angular position in which the elastic reaction is lowest.
Figure 6:
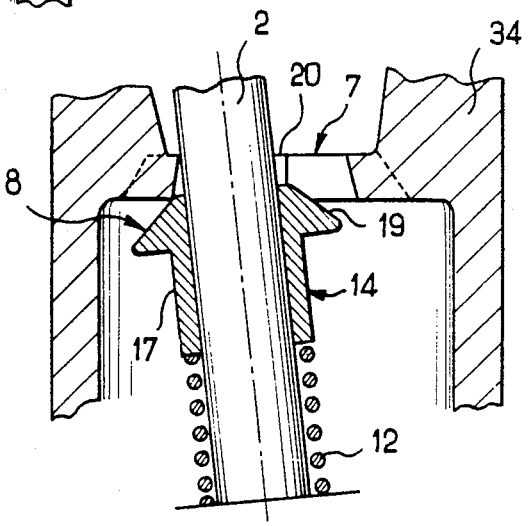
FIG. 6 is a similar view to FIG. 5 when the lever is inclined in an angular position in which the elastic reaction is greatest.
Figure 9:
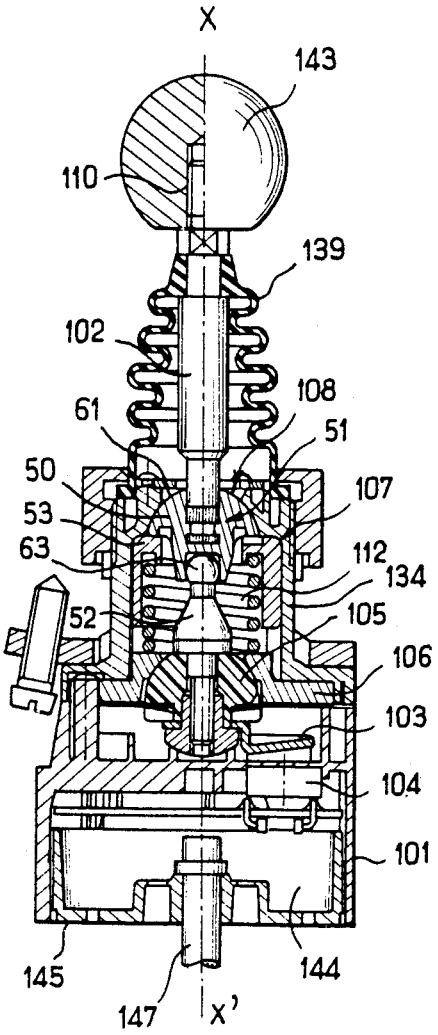
FIGS. 9 to 11 are similar views to FIGS. 1 to 3 showing a variant embodiment of the invention allowing large ranges of angular movement.
Figure 10:
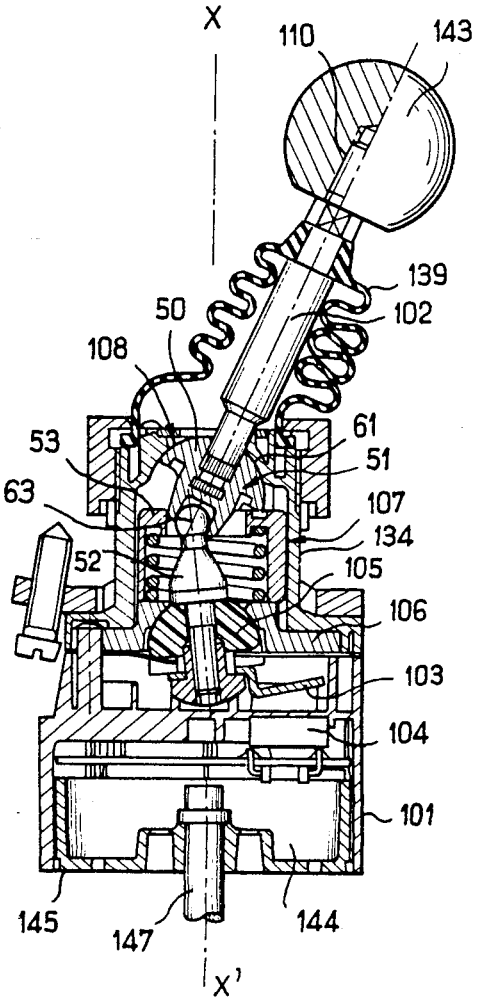

FIGS. 5 and 6 show the way in which the cams 7, 8 co-operate depending upon the orientation of the operating lever 2 with respect to its neutral position.

FIG. 5 shows the orientation of the lever 2 in one of the preferential planes P or Q. In this case the frustoconical part 19 of the slide 14 which forms the active surface 11 of the cam 8 engages in one of the notches 13 of the cam 7 so that the spring 12 is slightly compressed.

An orientation of the lever 2 in one of the planes R or S passing between the arms of the cross (FIG. 6), on the other hand, presses the slide 14 much more strongly towards the swivel joint 5 by application of the frustoconical surface of said slide 14 against the edge which separates the two notches 13 in question of the cam 7. Since the compression of the spring 12 is greater, the elastic resistance counteracting the movement of the lever 2 is substantially greater than in the first case.

When the operating lever 2 experiences a transverse thrust in the direction of one of the planes P, Q, R or S, and is then released, at least one of the sectors 28 of the swivel joint 5 is pushed back by the or each corresponding tab 27 of the diaphragm 26, and this also contributes to the expansion of the spring 12 spontaneously returning the lever 2 to the neutral position.

The above-described embodiment corresponds to a manipulator in which the angular range of movement of the lever is small, about 6°, and the elastic reaction of which counteracting the inclination of said lever is relatively large. This type of manipulator is very suitable for applications in which it is desired to transmit to the operator a manual sensation of force indicating operation of the device controlled by the manipulator. One of the possible applications is controlling the speed of an engine.

Conversely, in the variant described with reference to FIGS. 9 to 15, in which the same references plus the number 100 relate to members having similar functions, the operating lever 102 of the manipulator may have a larger range of angular movement (about 25°) in certain preferential directions.

To this end, lever 102 is connected by a spherical articulation 51 to an auxiliary shaft 52 housed in the casing 101 and itself mounted on a swivel join 105 elastically urged towards a fixed annular bearing surface 106 of the casing 101. In view of the step-down effect provided by the double articulation 51, 105, the elastic reaction counteracting the inclination of the lever 102 is, for example, four times less than in the case of the manipulator described with reference to FIGS. 1 to 8. Thus this type of manipulator can advantageously be used in applications in which it is desired that the amplitude of the signals delivered should reflect the larger amplitude movements of the lever.

A description will now be given only of those parts of this manipulator whose structure differs from the previous one. In this embodiment, the angularly fixed cam 107 (FIG. 11) is borne by a sliding push rod 53 surrounding the auxiliary shaft 52 and displaceable coaxially of the neutral position X–X′ of the lever 102.

Figure 11:
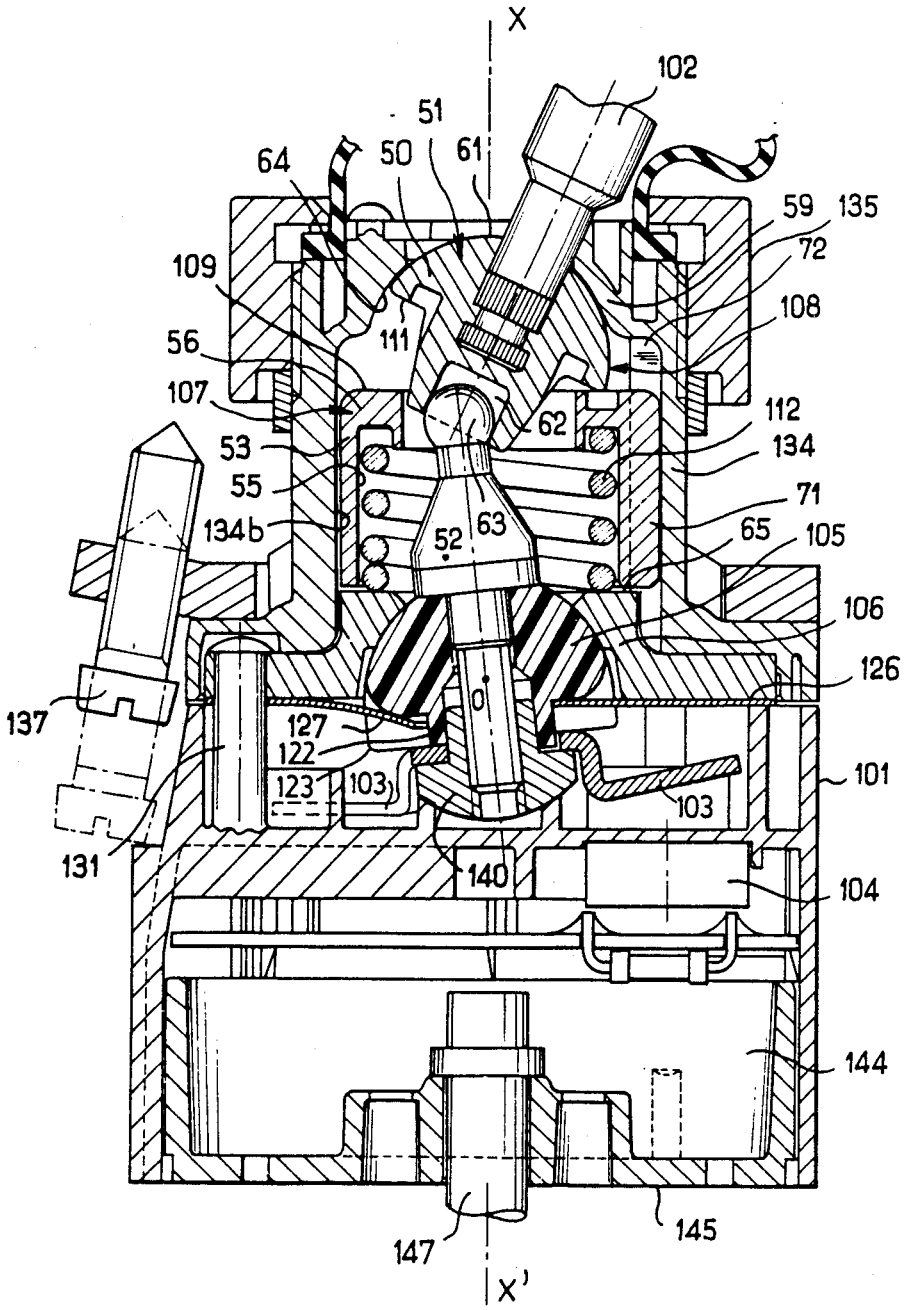

The push rod 53 is hollow and has a cylindrical skirt 55 sliding inside the chamber **134*b* of the barrel 134, rotation of the push rod 53 about the axis X–X′ being prevented by a longitudinal rib 71 of the skirt 55 engaging a slot 72 in the chamber 134*b* (see FIGS. 11, 13 and 15**).

The skirt 55 which surrounds the auxiliary shaft 52 and a return spring 112 has at the top a crown 56 whose wall 109 remote from the swivel joint 105 forms the active surface of the cam 107.

The spherical articulation 51 comprises a swivel joint 50 having a hemispherical head 61 co-operating with a spherical bearing surface 64 of a cam 59 of the barrel 134, which is open at the top to allow the passage of the lever 102. The latter is angularly secured to the swivel joint 50, the axial extension of which forms a cavity 62 in which the spherical head 63 of the auxiliary shaft 52 is engaged.

The periphery of the swivel joint 50 is corrugated and forms the active surface 111 of the cam 108. The active surfaces 109, 111 of the cams 107, 108 are elastically urged towards one another by the helical spring 112 which bears between a shoulder 65 of the annular bearing surface 106 and the crown 56 of the push rod 53. The thrust of the spring 112 also applies the hemispherical head 61 against the bearing surface 64.

In the neutral position of the operating lever 102 the periphery of the swivel joint 50 matches (see FIG. 9) the wall of the crown 56 of the push rod 53 remote from the swivel joint 105.

FIGS. 12 and 13, and 14 and 15 respectively illustrate two variant embodiments of the push rod 53 bearing the rotary cam 107 and of the swivel joint 50 bearing the cam 108 which rotates integrally with the operating lever 102.

The cams 107, 108 in the variant shown in FIGS. 14 and 15 have a continuous corrugated contour with a succession of points of inflexion while the cams in FIGS. 12 and 13 have a discontinuous corrugated contour respectively forming a succession of crests 82 and troughs 83 (see FIG. 13) or curved parts 74 (see FIG. 12).

The planes P and Q correspond to the trough parts of the profile 109 of the cam 107 and the planes R and S to the crests of this profile.

Irrespective of the embodiment concerned, when the operating lever 102 is oriented in one of the two planes P or Q along which the contour of the angularly orientable cam 108 matches that of the sliding cam 107, the swivel joint 50 pushes the push rod 53 slightly and the spring 112 on which the push rod 53 bears is slightly compressed.

Conversely, an orientation of the operating lever 102 in one of the two planes R, S along which the crests of some of the corrugations 70 or curved parts 74 of the cam 108 borne by the swivel joint 50 are applied against the crests of corrugations 80 or against corresponding crests 82 of the cam 107 borne by the push rod 53, tends to push the latter back more strongly and compress the spring 102 further. The elastic reaction counteracting the movement of the lever 102 therefore differs considerably in accordance with its angular orientation and this tends to limit the amplitude of the range of movement in the non-preferential directions.

When the lever 102 is released, the spring 112 participates for the same reason as the elastic diaphragm 126 supporting the swivel joint 105 rotating integrally with the auxiliary shaft 52 by returning lever 102 to its neutral position X–X'.

FIGS. 16 and 17 each illustrate a variant embodiment of the manipulators described respectively with reference to FIGS. 1 to 8 and 9 to 15. In FIGS. 16 and 17 those members which have similar functions bear the same references plus the index a.

According to these embodiments, the operating lever 2*a* (FIG. 16) or the auxiliary shaft 52*a* (FIG. 17) are connected to the casing 1*a*, 101*a* via a pseudo-articulation formed by an elastic material 75, e.g. an elastomeric material, the periphery 76 of which adheres to the inner surface 77 of an annular bearing surface 78 connected to the casing 1*a*, 101*a*.

The end of the lever 2*a* (FIG. 16) or of the auxiliary shaft 52*a* (FIG. 17) remote from the control knob 43*a*, 143*a*, bears a bush 79 which is locked in the elastomeric material 75 by being integrally moulded. Bush 79 bears the members 3*a*, 103*a* controlling the position pick-ups belonging to the manipulator electronic circuits (not shown).

The spring 12*a*, 112*a* biasing the cams 7*a*, 8*a* or 107*a*, 108*a* towards one another is mounted to bear on a washer 81 which is either fixed around the lever 2*a* a short distance from the elastomeric material 75 (FIG. 16) or supported by a shoulder 84 of the annular bearing surface 78 of the casing 101*a* (see FIG. 17). A pseudo-articulation of this kind is described in the above-mentioned Applicants' French Patent No. 2 559 305.

The elastic material 75 of the latter two variants economically replaces the swivel joint 5, 105 supported by the elastic diaphragm 26, 126 in the previous embodiments, but does not allow angular guidance.

The above examples, which have no limiting force, show that the invention can be modified in various ways without departing from the scope thereof.

We claim:

1. In a manipulator delivering signals characteristic of the orientation of a lever in space, such lever being movable, under transverse pressure, from a reference or neutral position, and elastically returned to said neutral position, said manipulator comprising a casing, a bearing surface stationary with said casing, a ball joint carried by said lever and resiliently urged against said bearing surface, said lever being connected to at least one movable member interacting with at least one pick-up for delivering an electrical signal responsive to the orientation of the lever, means resiliently opposing the angular displacement of said lever from its neutral position; the improvement in which said ball joint has radial ribs pointing away from the bearing surface and engaging corresponding radial slots formed in an elastic diaphragm between elastic tongues of said diaphragm which engage a base of said ball joint thereby to urge said ball joint against said bearing surface.

2. A manipulator according to claim 1, wherein the movable member is a member that remotely acts on position detectors.

3. A manipulator according to claim 1, wherein said lever is located in said casing and is connected by means of a universal joint to an operating lever articulated to the casing and accessible to the user.

4. A manipulator according to claim 1, wherein said ball joint is substantially hemispherical with said base being flattened, whereby a movement of inclination of said lever increases the bending deformation of at least some of said tongues, whereby said tongues bias said lever toward its neutral position.

5. In a manipulator delivering signals characteristic of the orientation of an operating lever in space, said lever being movable, under transverse pressure, from a reference or neutral position, and elastically returned to said neutral position, said manipulator comprising a casing, a lever articulated on said casing and controlling the position of at least one movable member interacting with at least one pick-up for delivering an electrical signal responsive to the position of said lever means resiliently opposing angular displacement of said lever with a force which is different for different orientations of said lever with respect to the neutral position, said means comprising active surfaces movable with respect to each other and resiliently biased against each other, one of said active surfaces being connected with said lever for displacement therewith when said lever is moved toward and away from its neutral position and another of said active surfaces being connected to the casing, at least one of said active surfaces being provided with an annular array of corrugations the amplitude of which is dependent on the possible orientations of the lever; the improvement in which said active surface which is connected to said lever is an annular surface surrounding the axis of said lever, and the other surface is carried by a push-rod which is displaceable in a coaxial relationship with the neutral position of said lever and is urged into engagement with said one surface by a biasing spring.

6. A manipulator according to claim 5, wherein said annular surface surrounding the axis of said lever is carried by a ball joint connected to said lever and by means of which said lever is articulated on said casing.

7. A manipulator according to claim 5, wherein the operating lever is connected by means of a universal joint to an auxiliary lever located within said casing, said auxiliary lever is surrounded by the push-rod, is connected to said casing by a universal joint, and controls the positions of the movable member.

8. A manipulator according to claim 5, characterized in that the active surfaces (9, 11; 119, 111) of the two cams (7, 8; 107, 108) have complementary profiles and the profile of one matches that of the other in the neutral position of the operating lever (21, 102).

* * * * *